US006498913B1

(12) United States Patent
Tooker et al.

(10) Patent No.: US 6,498,913 B1
(45) Date of Patent: Dec. 24, 2002

(54) STATIC CHARGE CONTROLLING SYSTEM AND A REPRODUCTION MACHINE HAVING SAME

(75) Inventors: Ana P. Tooker, Penfield, NY (US); Barbara J. Schaeffer, Penfield, NY (US); James D. Walsh, Rochester, NY (US); William H. Wayman, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/939,489

(22) Filed: Aug. 27, 2001

(51) Int. Cl.[7] ..... G03G 21/00; G03G 15/00

(52) U.S. Cl. ..... 399/90; 399/128; 361/214; 361/221

(58) Field of Search ..... 399/90, 91, 128, 399/162, 361; 361/214, 221

(56) References Cited

U.S. PATENT DOCUMENTS 3,671,806 A * 6/1972 Whitmore et al. ..... 361/212
4,363,070 A * 12/1982 Kisler ..... 361/212
5,065,196 A * 11/1991 Kanaya et al. ..... 226/94

FOREIGN PATENT DOCUMENTS

JP 11-217133 * 8/1999

* cited by examiner

*Primary Examiner*—Joan Pendegrass
(74) *Attorney, Agent, or Firm*—Tallam I. Ngutt

(57) ABSTRACT

A static controlling system is provided for effectively and economically controlling static charge build up on a driven web member moving in contact with support structures. The static controlling system includes (a) at least one resistive contact member for contacting the surface of the driven web member, and (b) a bias source coupled to the resistive contact member for biasing the resistive contact member to apply to the surface of the driven web member a neutralizing bias, having a selected polarity and potential level, thereby effectively neutralizing and controlling static charge build up on the driven web member.

11 Claims, 8 Drawing Sheets

STATIC CHARGE CONTROLLING SYSTEM AND A REPRODUCTION MACHINE HAVING SAME

BACKGROUND OF THE INVENTION

The present invention relates generally to static charge removing systems, and more particularly to a belt toner image or electrostatographic reproduction machines including an effective and economical static charge controlling system.

Static charges, as is well known, ordinarily are generated when two objects are rubbed together. In an electrostatographic reproduction machine that has a belt photoreceptor, it has been found that static charges ordinarily are generated during each revolution when such a belt photoreceptor is driven over objects such as backer bars and rolls. In fact, ordinarily such static charges actually build up revolution after revolution with undesirable machine failure consequences (to be discussed in detail below).

In a typical toner image reproduction machine, for example an electrostatographic printing process machine, portions of a rotatable photoconductive member in the form of a drum or a belt, is charged to a substantially uniform potential so as to sensitize the surface thereof. The charged portions of the photoconductive member are exposed to a light image of an original document being reproduced. Exposure of the charged photoconductive member thus selectively dissipates the charges thereon in the exposed areas. Such exposure forms an electrostatic latent image on the photoconductive member that corresponds to the informational areas contained within an original document to be reproduced.

After the electrostatic latent image is formed on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a sheet media. The toner particles are then heated to permanently affix the powder image to the sheet media.

The foregoing generally describes a typical black and white electrostatographic printing machine. With the advent of multicolor electrophotography, it is desirable to use a reproduction machine architecture, which comprises a plurality of image forming stations. One example of the plural image forming station architecture utilizes an image-on-image (IOI) system in which the photoreceptive member is recharged, re-imaged and developed for each color separation. This charging, imaging, developing and recharging, re-imaging and developing, all followed by transfer to a sheet, is done in a single revolution of the photoreceptor in so-called single pass machines, while multi-pass architectures form each color separation with a single charge, image and develop, with separate transfer operations for each color.

In either case, particularly where the machine includes a photoconductive or photoreceptive member in the form of a driven web or belt, the web or belt is typically driven over at least a series of rollers. In relatively large such machines, the photoreceptor belt can easily require running over a total of twenty or more backer bars and rubber rolls, during which as pointed out above, it generates static charge during every revolution. The charge generated thus has been found to cause the photoreceptor belt to tend to be attracted to the backer bars and rolls.

Such attraction is exhibited, and can be measured, as an increase in belt drag levels. If such generated static is left uncontrolled, static levels on the back of the belt can become so high, they can cause the belt drag to exceed the drive capacity of the drive rolls and/or of the drive motors. In addition, there are other associated failures that can range from (a) motion quality errors resulting from slip/stick conditions of the belt to the drive rolls, (b) increases in image misregistration, (c) drive motors running out of control and/or stalling due to an excessive motor current fault, and (d) significant charge levels on the photoreceptor belt that can interfere with or hinder a technicians efforts to remove and replace the belt during service.

Therefore there is a need for an effective system for controlling static charge build up on a rotating web or belt, for example, the photoreceptor belt of an electrostatographic reproduction machine.

SUMMARY OF THE INVENTION

In accordance with one aspect of the present invention, there is provided a static controlling system is provided for effectively and economically controlling static charge build up on a driven web member moving in contact with support structures. The static controlling system includes (a) at least one resistive contact member for contacting the surface of the driven web member, and (b) a bias source coupled to the resistive contact member for biasing the resistive contact member to apply to the surface of the driven web member a neutralizing bias, having a selected polarity and potential level, thereby effectively neutralizing and controlling static charge build up on the driven web member.

In accordance with another aspect of the present invention there is provided a static controlling system is provided for effectively and economically controlling static charge build up on a driven web member moving in contact with support structures. The static controlling system includes (a) devices for sensing a level and a polarity of static charge build up on a surface of the driven web member, (b) at least one resistive contact member for contacting the surface of the driven web member, and (c) a bias source coupled to the resistive contact member for biasing the resistive contact member to apply to the surface of the driven web member a neutralizing bias, having a selected polarity and potential level, thereby effectively neutralizing and controlling static charge build up on the driven web member.

In accordance with a further aspect of the present invention, there is provided a static controlling system for effectively and economically controlling static charge build up on a driven web member, for example, a driven belt member moving in contact with support structures. The static controlling system includes (a) at least one conductive passive member contacting the driven web member, for example, a driven belt member for dissipating a first degree of static charge from the driven web member, for example, a driven belt member, and (b) an active static removing assembly for additionally dissipating a second and desired degree of static charge from the driven web member, for example, a driven belt member. The active static removing assembly includes a conductive contact member for contacting the driven web member, for example, a driven belt member, and a bias source for biasing the conductive contact member to apply a neutralizing bias, having a selected polarity, to the driven web member, for example, a driven belt member, thereby effectively controlling static charge build up on the driven web member, for example, a driven belt member.

In yet another aspect of the present invention, there is provided an electrostatographic reproduction machine including (a) a series of belt drive and support members, (b) a closed loop belt image bearing member having an imaging surface for carrying a toner image and a backside in contact with the series of belt drive and support members, (c) a sheet supply and handling assembly for moving a copy sheet into a toner image transfer relationship with the closed loop belt image bearing member, (d) imaging devices for forming a toner image on the imaging surface of the closed loop belt image bearing member and transferring the toner image to the copy sheet, and a static controlling system is provided for effectively and economically controlling static charge build up on a driven web member moving in contact with support structures. The static controlling system includes (a) devices for sensing a level and a polarity of static charge build up on a surface of the driven web member, (b) at least one resistive contact member for contacting the surface of the driven web member, and (c) a bias source coupled to the resistive contact member for biasing the resistive contact member to apply to the surface of the driven web member a neutralizing bias, having a selected polarity and potential level, thereby effectively neutralizing and controlling static charge build up on the driven web member.

BRIEF DESCRIPTION OF THE DRAWINGS

The foregoing and other features of the instant invention will be apparent and easily understood from a further reading of the specification, claims and by reference to the accompanying drawings in which:

DETAILED DESCRIPTION OF THE INVENTION

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

Figure 1:
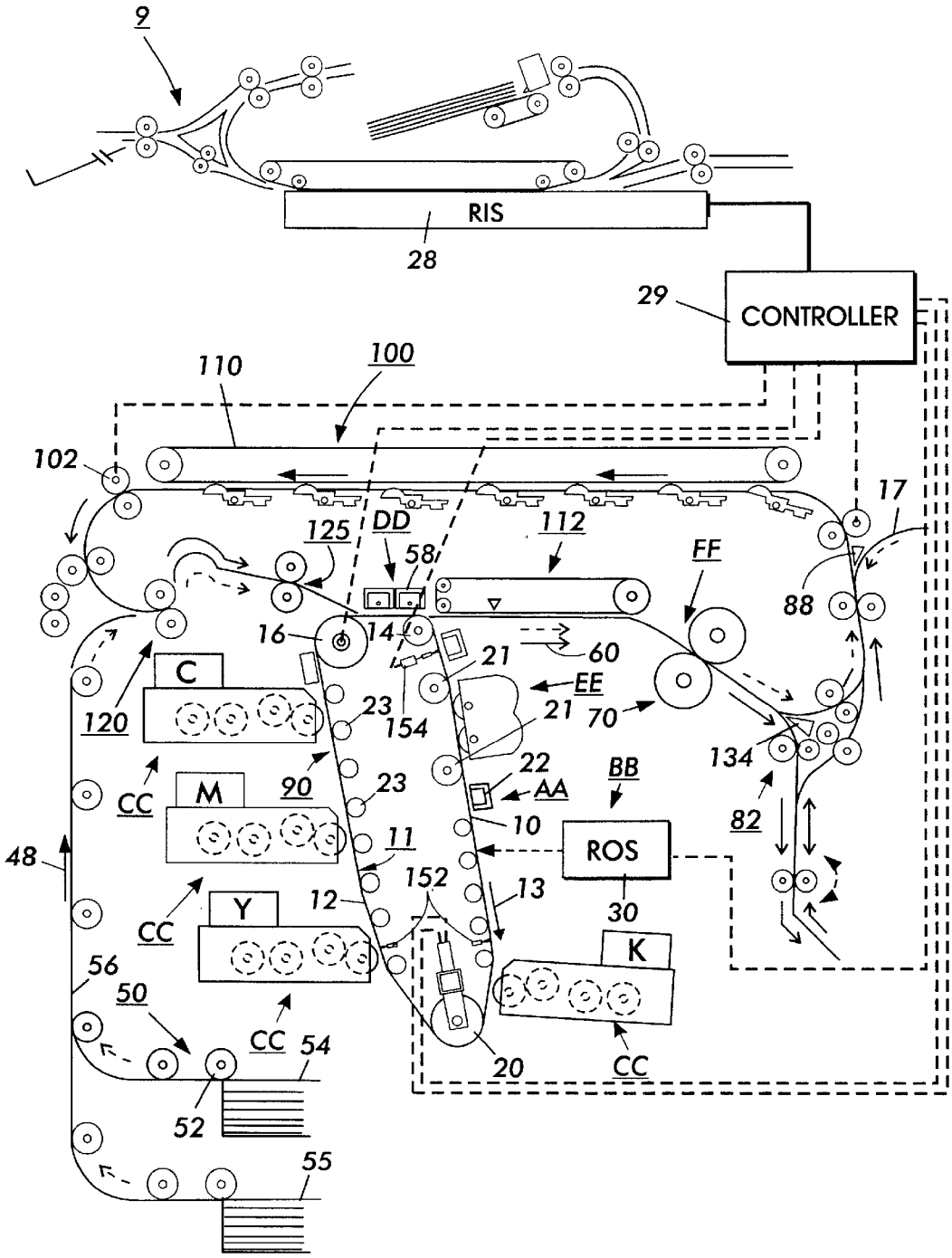
FIG. 1 is a schematic elevational view of an exemplary electrostatographic reproduction machine including the static controlling system of the present invention.

Referring first to FIG. 1, it schematically illustrates an electrostatographic reproduction machine 9 which generally employs a photoconductive belt 10 mounted on a belt support module 90. Preferably, the photoconductive belt 10 is made from a photoconductive material coated on a conductive grounding layer which, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona generating device indicated generally by the reference numeral 22 charges the photoconductive belt 10 to a relatively high, substantially uniform potential.

As also shown the reproduction machine 9 includes a controller or electronic control subsystem (ESS) 29 which is preferably a self-contained, dedicated mini-computer having a central processor unit (CPU), electronic storage, and a display or user interface (UI). The ESS 29, with the help of sensors and connections, can read, capture, prepare and process image data and machine status information.

Referring again to FIG. 1, at an exposure station BB, the controller or electronic subsystem (ESS), 29, receives the image signals from RIS 28 representing the desired output image and processes these signals to convert them to a continuous tone or gray scale rendition of the image which is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 9 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, which include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Preferably, sheet feeding apparatus 50 includes a corrugated vacuum feeder (TCVF) assembly 52 for contacting the uppermost sheet of stack 54, 55. TCVF 52 acquires and advances the sheet from stack 54, 55 to vertical transport 56. Vertical transport 56 directs the advancing sheet 48 of support material through feed rolls 120 into registration transport 125, then past image transfer station DD to receive an image from photoreceptor belt 10 in a timed sequence so that the toner powder image formed thereon contacts the advancing sheet 48 at transfer station DD. Transfer station DD includes a corona-generating device 58, which sprays ions onto the backside of sheet 48. This attracts the toner powder image from photoconductive surface 12 to sheet 48. After transfer, sheet 48 continues to move in the direction of arrow 60 where it is picked up by a pre-fuser transport assembly 112 for transport to fusing station FF.

The sheet then passes through fuser 70 where the image is permanently fixed or fused to the sheet. After passing through fuser 70, a gate 88 either allows the sheet to move directly via output 17 to a finisher or stacker, or deflects the sheet into the duplex path 100. Specifically, the sheet when to be directed into the duplex path 100, is first past through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and fiber particles adhering to photoconductive surface 12 are removed therefrom at cleaning station EE.

In general, it is known that static charges can be generated when two appropriate objects are rubbed together. Driven webs or belts, such as photoreceptor belt 10, when driven over stationary members such as backer bars 23 and rolls 14, 16 and 20, tend to generate charge on every revolution thereof. The charge generated causes the plural number of stationary backer bars 23 to generate static charge on every revolution. The charge generated causes the photoreceptor 10 to be more attracted to the backer bars 23 as well as to the rolls 14, 16 and 20. This attraction at first is only an increase in belt drag.

However, if left uncontrolled, the charge generated will grow and the attraction. will become strong enough to cause the drag to exceed the drive capacity of the drive roll and/or drive motor. This then causes one of at least two faults, a motor over speed or an excessive motor current fault. In addition to these faults, the charges on the photoreceptor hinder the removal of the belt during service.

The need to control static charge build up on the photoreceptor belt 10 is due in part to the construction of the photoreceptor belt 10. As is well known, the back surface 176 of the belt 10, referred to as the ACB( Anti Curl Back) layer, is made of a poly carbonate material. This material is non conductive for the most part, and thus charges tend to build up on it as it is run over members such as rollers and stationary backer bars. The next layer to the ACB layer is the ground plane layer which, in a machine, has a passive brush in contact with it for grounding the photoreceptor. Discharging through such grounding is further enabled by the addition of conductive additives placed in the frontward layers of the photoreceptor. The back surface 176 however does not have these conductive additives and thus cannot and does not conduct any charges thereon to the ground plane.

Figure 4:
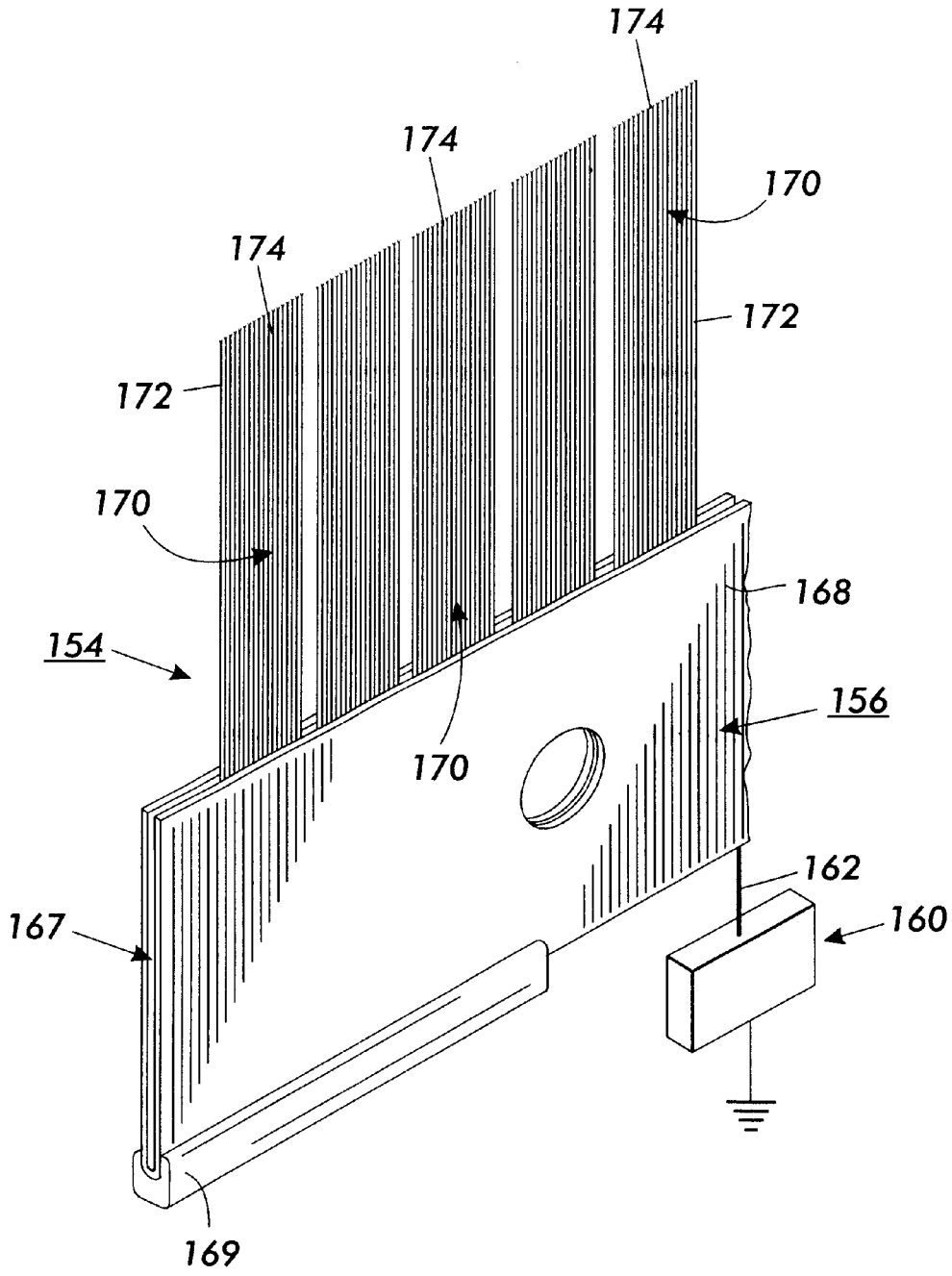
FIG. 4 is an enlarged illustration of an active static removing assembly of the static controlling system of the present invention.

Therefore, in order to remove such charges from the back surface 176, additional means must be provided, hence the present invention. In accordance with the present invention, this is done as shown in FIGS. 1 and 4, by having a contact member such as a passive brush 154 with highly resistive fibers 172 in direct contact with the back surface 176 of the belt 10. The brush 154 is insulated from the machine ground, and the bias voltage 162 is applied by bias source 160 to this passive brush 154. By setting this bias voltage 162 to a desired particular level, the static charges on the back surface 176 of the belt 10 can be effectively controlled and maintained within an acceptable level.

Referring now to FIGS. 2 to 8, the reproduction machine 9 therefore includes the static controlling system 150 of the present invention (to be described in detail below) that is suitable for effectively and economically controlling static charge build up on a driven web member, for example, on a driven belt member such as the photoreceptor belt 10, as it is moved in contact with support structures such as 14, 16, 20 and 23 as shown.

Although the static controlling system 150 is disclosed and described with reference to a photoreceptor belt 10 in an image reproduction machine, it is understood that it is equally applicable to any driven web member, for example, a driven web of paper or sheet feed roll, and of course of any belt member that suffers from static charge build up as described above.

Thus the present invention generally is directed to a static controlling system 150 for effectively and economically controlling static charge build up on a surface of a driven web member moving in contact with support structures. The static controlling system as such can include at least one contact member 154 for contacting the surface of the driven web member, and a bias source 160 coupled to the contact member for biasing the contact member to apply to the surface of the driven web member, a neutralizing bias 162, that is selected to have a desired polarity and potential level for neutralizing built up static charge, thereby effectively neutralizing and controlling static charge build up on the driven web member. As further shown in FIG. 1, the static controlling system 150 may further means such as the ESV 164 for sensing a level and a polarity of static charge build up on a surface of the driven web member. Such sensing can be done either once prior to the selection of the polarity and potential level of the bias 162, or it can be done in a closed loop system involving the controller 29, with dynamic sensing and responsive an appropriate biasing effectively neutralizing and controlling static charge build up on the driven web member.

In either case, the static controlling system 150 as illustrated includes at least one conductive passive member 152 contacting the driven web member, for example, a driven belt member or closed loop belt image bearing member 10 for dissipating a first degree of static charge therefrom, or the static controlling system 150 could also include an active static removing assembly 154 for additionally dissipating a second and desired degree of static charge from the driven web member, for example, a driven belt member or closed loop belt image bearing member 10. The active static removing assembly 154 has a conductive contact member 156 for contacting the driven web member, for example, a driven belt member or closed loop belt image bearing member 10. The active static removing assembly 154 also includes a bias source 160 for biasing the conductive contact member 156 to apply a neutralizing bias 162, that has a selected polarity, to the driven web member, for example, a driven belt member or closed loop belt image bearing member 10, thereby effectively controlling static charge build up on the closed loop belt image bearing member, and substantially preventing undesirable resultant machine failures.

The at least one conductive, but highly resistive passive member 152 comprises a brush that is in constant contact with the back surface 176 of the driven web member, for example, a driven belt member or closed loop belt image bearing member 10. As shown, the at least one conductive but highly resistive passive member 152 may comprise a grounded carbon brush, and the contact member 156 comprises an insulated conductive, but highly resistive brush.

The bias source 160 comprises a DC power supply, and the selected polarity of the neutralizing bias is opposite to a sensed polarity of static charge building up on the driven web member, for example, a driven belt member or closed loop belt image bearing member 10. The DC power supply or bias source 160 applies a bias 162 having a level of potential sufficient to produce a current equal to a current being induced in the driven web member, for example, a driven belt member or closed loop belt image bearing member 10 by the second degree of static charge.

The machine 9 includes at least one electrostatic voltage sensor (ESV) 164 for measuring the sense and level of voltage, as well as the current level induced in the driven web member, for example, a driven belt member due to built up static charge thereon,.

Figure 3:
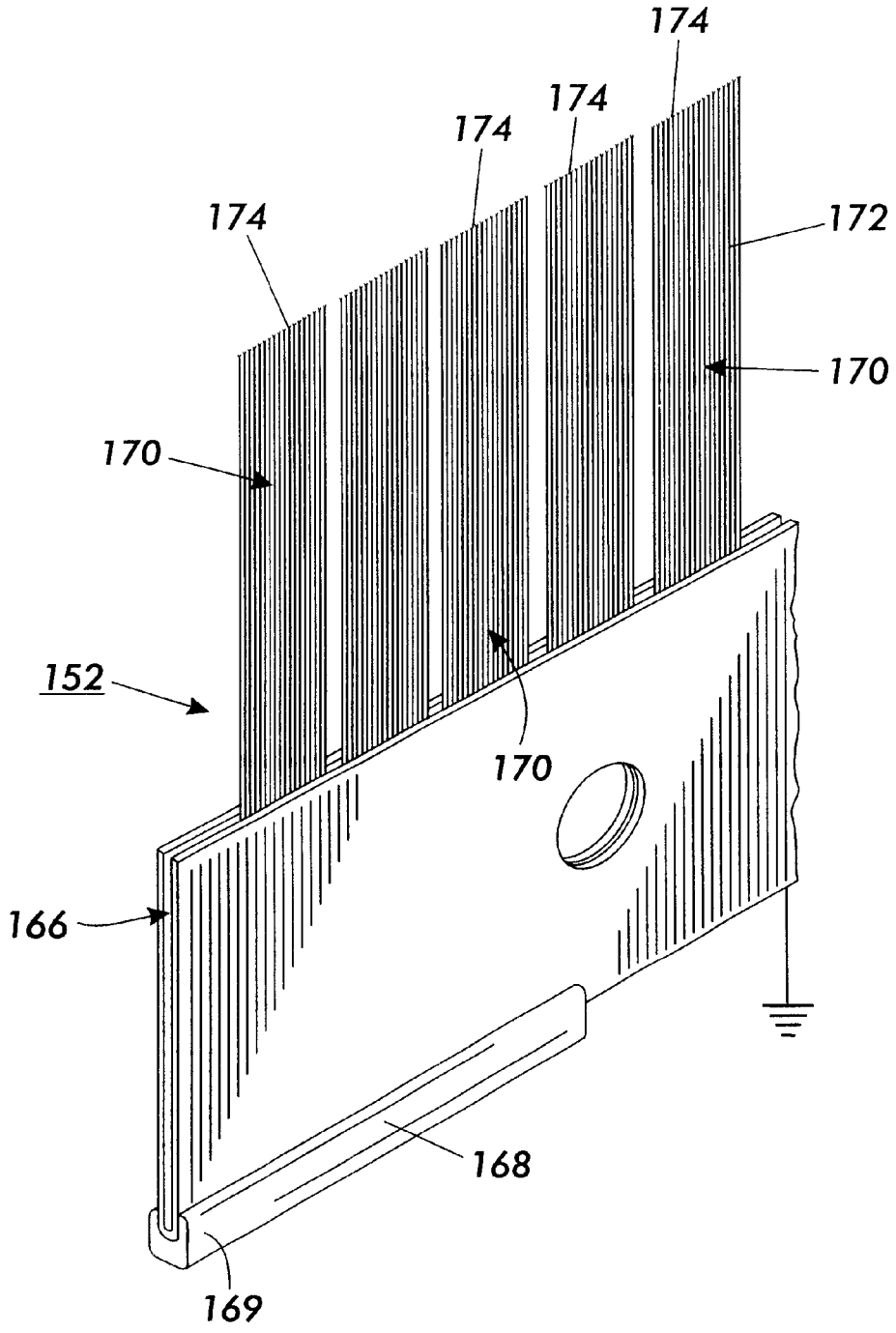
FIG. 3 is an enlarged illustration of a grounded conductive static removing member of the static controlling system in the form of a brush.

Referring in particular to FIG. 3, an enlarged isometric view of the passive member 152 is shown, and comprises a grounded static removing brush 166 and a support or holder 168. The support or holder 168 can comprise a piece of conductive metal wrapped around a plurality of spaced, discrete bundles 170 of individual resistive brush fibers 172. The resistivity of the fibers is selected in a range so that static charge can be easily conducted, but not so conductive that loose fibers could short out low voltage electronics. For the purpose of this invention "conductive" is used to mean static conductive. The individual bundles of fibers are highly resistive and may be held in place merely by the crimping of the conductive metal support or holder 168 around the fibers and then connecting the support 168 to ground potential as shown.

Figure 2:
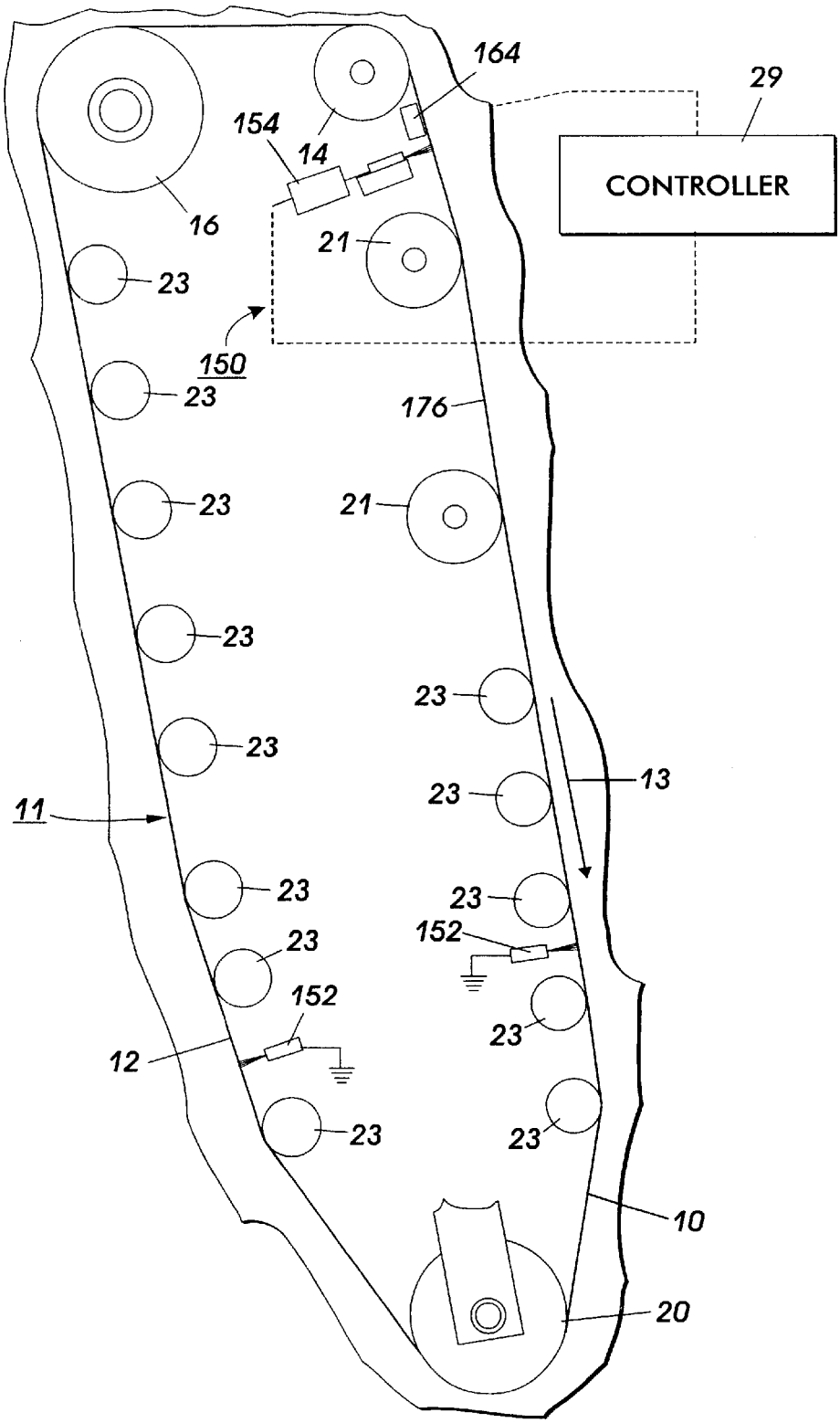
FIG. 2 is an enlarged view of the photoreceptor driven web member, for example, a driven belt member portion of the machine of FIG. 1, including the static controlling system of the present invention.

The ends 174 of the fibers 172 may be in contact with the backside 176 of the image bearing member or photoreceptor belt 10 on which it is desired to reduce the static charge as illustrated in FIGS. 1 and 2. In operation, the ends of the fibers come into direct contact with the backside 176 of the photoreceptor belt 10 having a static electrical charge, and the brush fiber ends 174 are deflected by the backside of the photoreceptor belt 10. The brush fibers 172 are connected to a conductive support which in turn is grounded to provide a conductive path to reduce the static electrical charge on the back surface 176 of the photoreceptor belt 10. As is well known, the brush fiber ends 174 may also be spaced from the backside 176 of the photoreceptor belt 10 bearing a static electrical charge thus functioning as an inductive device for removal of the static electrical charge from the backside of the photoreceptor. In this mode of operation, the static charge on the backside of the photoreceptor belt 10 creates an electric field that causes air breakdown or ionization to occurs, resulting in an electric current that flows to and through the brush fibers to ground from the backside of the photoreceptor belt 10.

In other words, the electrostatographic reproduction machine 9 includes a series of belt drive and support members 14, 16, 20, and 23. The machine 9 includes a driven web member, for example, a driven belt member or closed loop belt image bearing member 10 having an imaging surface 12 for carrying a toner image and a backside or surface 176 in contact with the a series of belt drive and support members 14, 16, 20 and 23. A sheet supply and handling assembly 50 is provided for moving a copy sheet 48 into a toner image transfer relationship with the driven web member, for example, the driven belt member or closed loop belt image bearing member 10. Imaging devices, e.g. 22, 30, are located adjacent the driven web member, for example, a driven belt member or closed loop belt image bearing member 10 for forming a toner image on the imaging surface 12, and transferring the toner image to the copy sheet. The machine 9 also includes a static controlling system 150 for effectively and economically controlling static charge build up on the driven web member, for example, a driven belt member or closed loop belt image bearing member 10 as it moves in contact with the series of belt drive and support members 14, 16, 20, and 23.

Referring in particular to FIGS. 4–8, an enlarged isometric view of the static removing assembly 154 of the static controlling system 150 is illustrated. As shown, the static removing assembly 154 similarly comprises a grounded static removing brush 166 and a support or holder 168. The support or holder 168 can comprise a piece of conductive metal wrapped around a plurality of spaced, discrete bundles 170 of individual brush fibers 172. The individual bundles of fibers are highly resistive and may be held in place merely by the crimping of the conductive metal support or holder 168 around the fibers, and in this case, the support member 168 is then connected or coupled to the bias source 160 for receiving the static neutralizing bias 162. The ends 174 of the fibers 172 may be in contact with the backside 176 of the image bearing member or photoreceptor belt 10 on which it is desired to reduce the static charge as illustrated in FIGS. 1 and 2.

The static neutralizing bias 162 for example can be a negative DC bias voltage that is applied to the brush. The actual polarity is responsively opposite to a sensed polarity of static charge on the backside 176 of the belt member 10. The polarity and level range of the static build up can be sensed during design, and the system 150 then designed to neutralize it as sensed then, or it can, in a closed loop system, be sensed in real time and responsively controlled with the aid of controller 29, in accordance with the present invention. This bias application substantially limits charge buildup that otherwise would occur on the belt 10 as it rubs against multiple backer bars 23, for example. Such a charge buildup, for example, undesirably increases the drag torque on the driven belt 10.

In accordance with another aspect of the present invention, the static controlling system 150 includes at least one, and may be plural belt contacting devices 152, 154 for neutralizing, or at least ameliorating the static charge generated on the inner or backside surface 176 of a photoreceptor belt 10 during operation. The first device 152 contacts the inner surface 176 of the belt with at least one grounded carbon fiber brush 166. When a second device is used alone or in combination with the first device, the second device 154 contacts the inner surface 176 of the belt with an insulated active brush 167 and applies a DC bias 162 to the brush. The passive static brush 166 and the active brush 167 are each mounted on an electrically insulating block 169.

Figure 5:
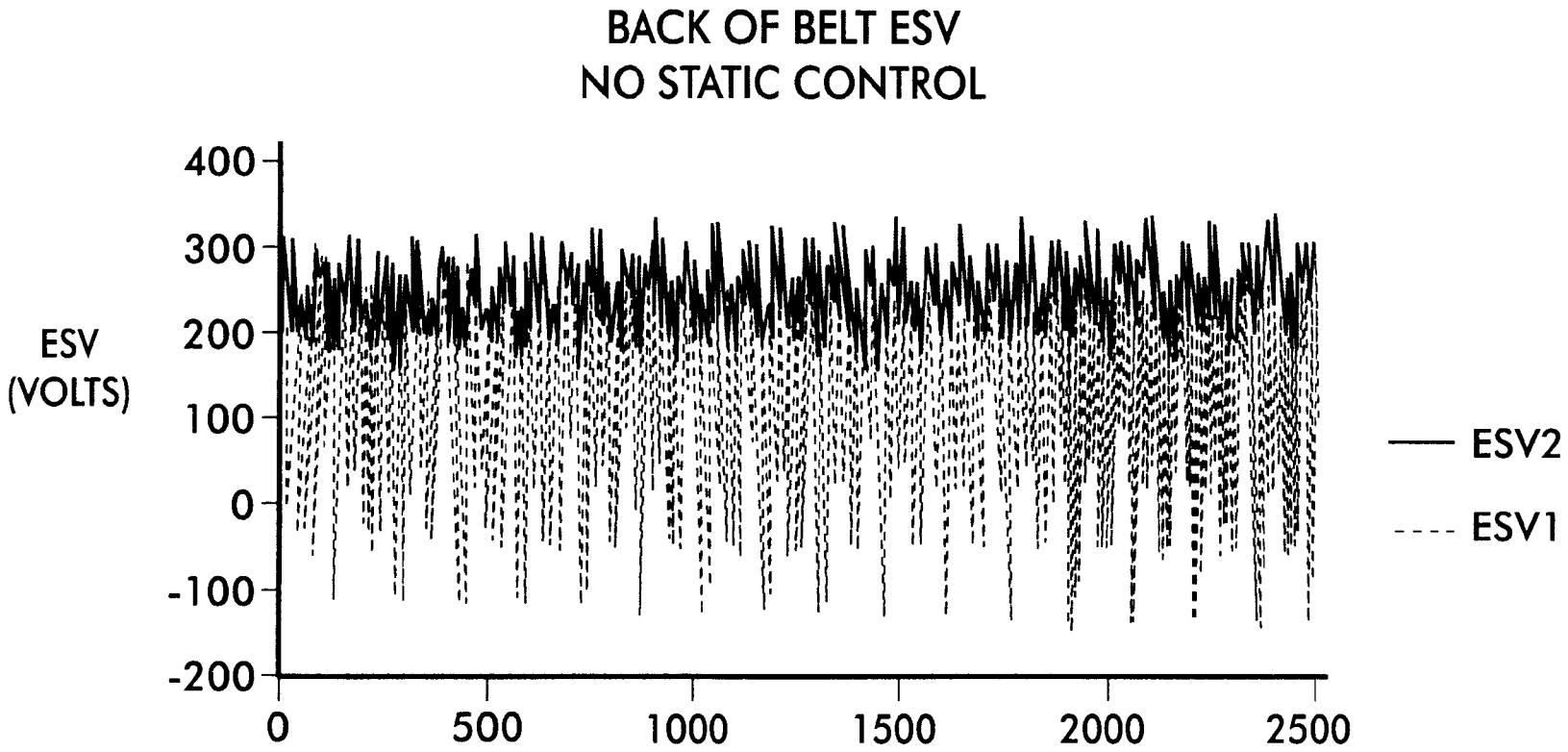
FIG. 5 (PRIOR ART)
FIGS. 5 and 6 as labeled are ESV voltage readings over time without use, and with use, respectively of the static controlling system of the present invention.
Figure 7:
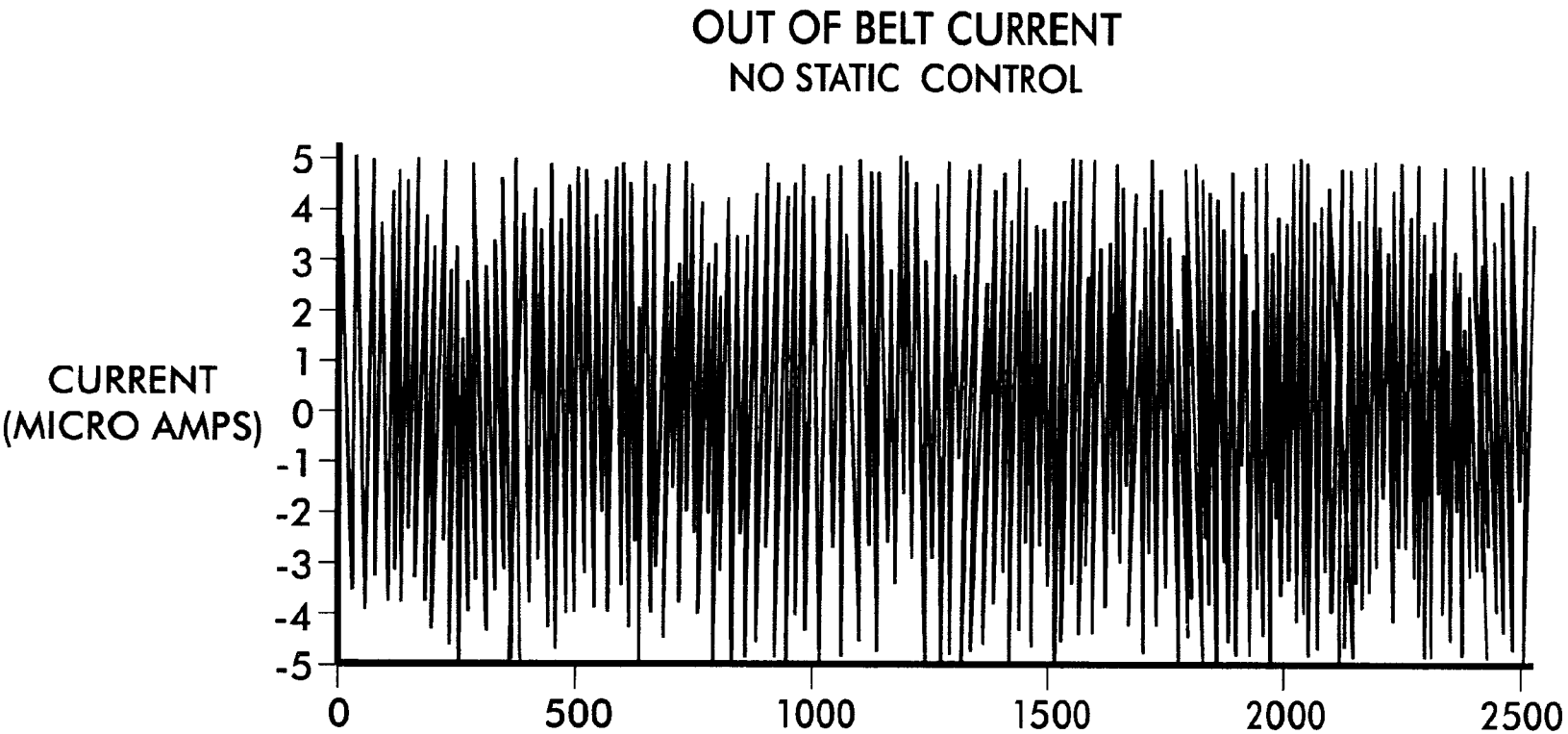
FIG. 7 (PRIOR ART)
FIGS. 7 and 8 as labeled are ESV voltage readings over time without use, and with use, respectively of the static controlling system of the present invention.

Referring now to FIGS. 5 and 7, these FIGS. show prior art Electrostatic Voltmeter (ESV) voltage and current flow on a driven belt, such as the belt 10 without application of the static controlling system 150 of the present invention. Accordingly, FIG. 5 is a plot of the uncontrolled or unameliorated Electrostatic Voltage measured by the ESV 164 on the backside 176 of the belt 10. Similarly, FIG. 7 is a plot of the unameliorated or uncontrolled current flowing through the ground plane of the belt 10 due to the charge generated and built-up on the backside 176. Both these plots show dynamic measurements as the belt is rotating.

Figure 6:
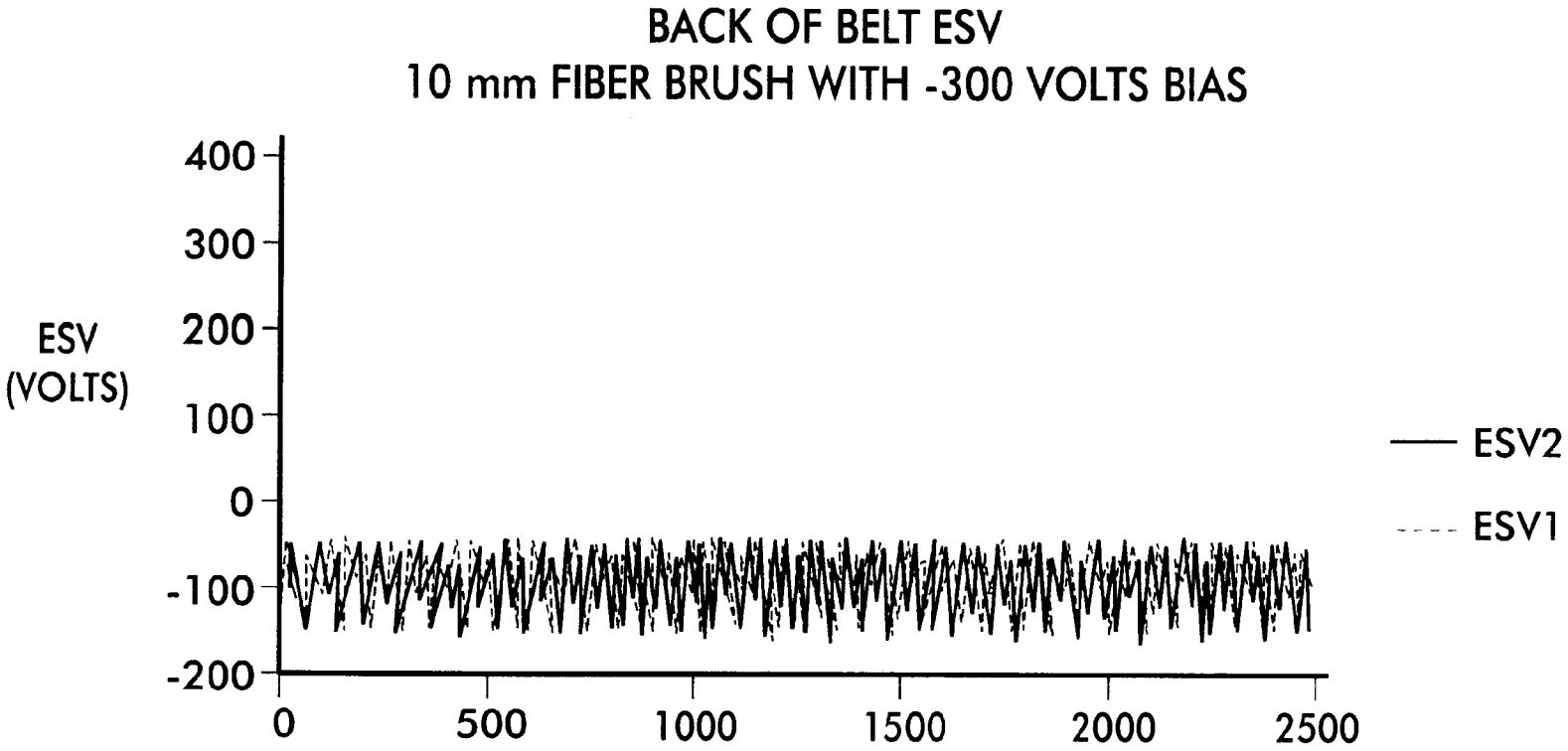
Figure 8:
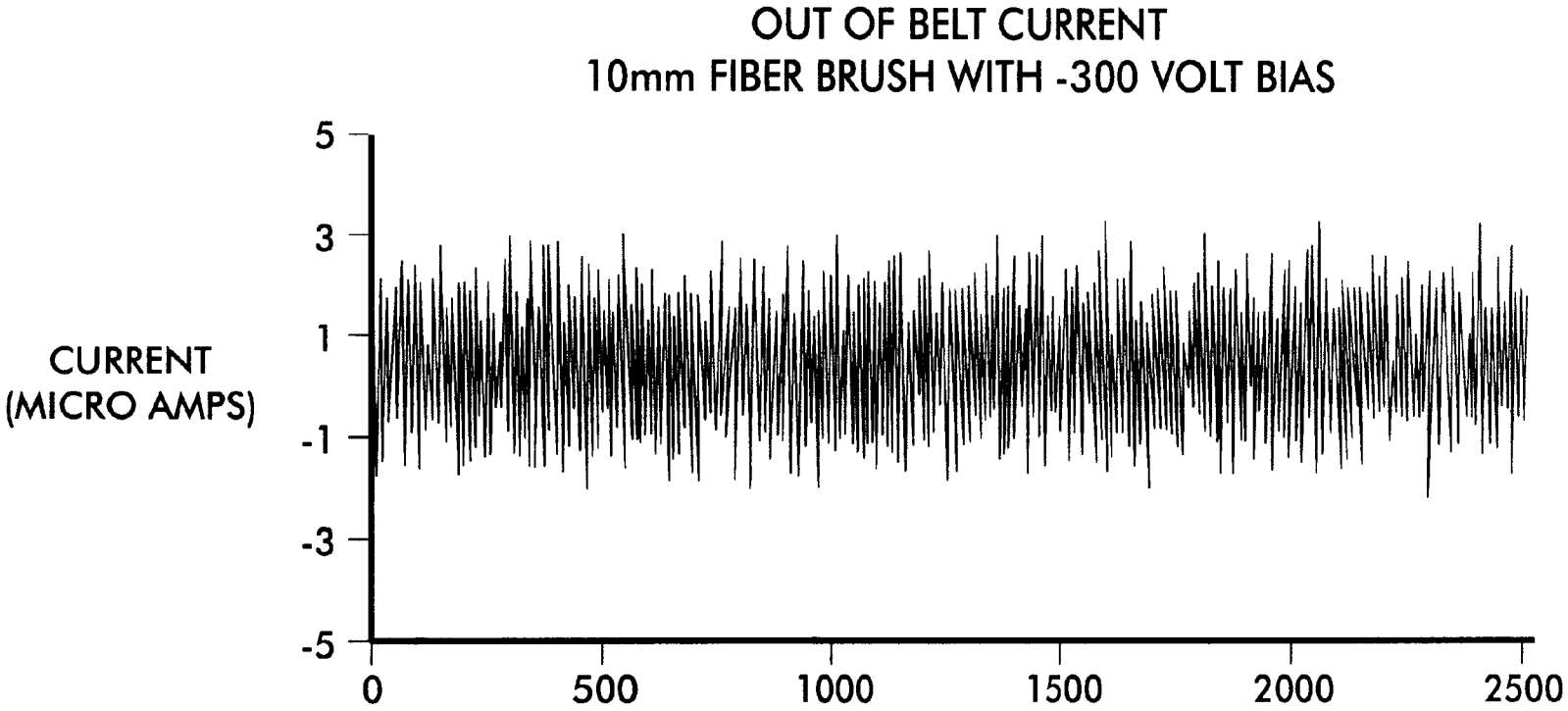

Referring now to FIGS. 6 and 8, these FIGS. show controlled or ameliorated ESV voltage, and controlled or ameliorated current on the driven belt, such as the belt 10 after installation and application of the static controlling system 150 of the present invention. Accordingly, FIG. 6 is a plot of the controlled or ameliorated Electrostatic Voltage (ESV) measured on the backside 176 of the belt, and FIG. 8 is a plot of the controlled or ameliorated current flowing through the ground plane of the belt 10 due to the charge generated and built-up on the backside 176. Both these plots are again dynamic measurements as the belt is rotating. Note that in FIGS. 6 and 8, as opposed to FIGS. 5 and 7, ESV readings for the backside 176 of belt 10 are now negative, and the deviation in each case is considerably smaller.

These tests for the readings so plotted were done with an open loop system. The power supply used for biasing had no feedback to cause adjustment to the biasing, and the biasing was preset at a nominal voltage. This system could be further refined to include closed loop feedback to control the polarity and level of bias applied for static control.

As can be seen, there has been provided a static controlling system is provided for effectively and economically controlling static charge build up on a driven web member moving in contact with support structures. The static controlling system includes (a) at least one resistive contact member for contacting the surface of the driven web member, and (b) a bias source coupled to the resistive contact member for biasing the resistive contact member to apply to the surface of the driven web member a neutralizing bias, having a selected polarity and potential level, thereby effectively neutralizing and controlling static charge build up on the driven web member.

While the invention has been described with reference to the structure herein disclosed, it is not confined to the details as set forth and is intended to cover any modification and changes that may come within the scope of the following claims.

What is claimed is:

1. An electrostatographic reproduction machine comprising:

(a) a series of belt drive and support members;

(b) a closed loop belt image bearing member having an imaging surface for carrying a toner image and a backside in contact with said series of belt drive and support members;

(b) a sheet supply and handling assembly for moving a copy sheet into a toner image transfer relationship with said closed loop belt image bearing member;

(c) imaging devices for forming a toner image on said imaging surface of said closed loop belt image bearing member and transferring the toner image to the copy sheet; and (d.) a static controlling system for effectively and economically controlling static charge build up on said closed loop belt image bearing member moving in contact with said series of belt drive and support members, said static controlling system including:

(i) at least one resistive contact member for contacting the surface of the driven web member; and (ii) a bias source coupled to said resistive contact member for biasing said resistive contact member to apply to the surface of the driven web member a neutralizing bias, having a selected polarity and potential level, thereby effectively neutralizing and controlling static charge build up on the driven web member.

2. An electrostatographic reproduction machine comprising:

(a) a series of belt drive and support members;

(b) a closed loop belt image bearing member having an imaging surface for carrying a toner image and a backside in contact with said series of belt drive and support members;

(b) a sheet supply and handling assembly for moving a copy sheet into a toner image transfer relationship with said closed loop belt image bearing member;

(c) imaging devices for forming a toner image on said imaging surface of said closed loop belt image bearing member and transferring the toner image to the copy sheet; and (d.) a static controlling system for effectively and economically controlling static charge build up on said closed loop belt image bearing member moving in contact with said series of belt drive and support members, said static controlling system including:

(i) at least one conductive passive member for contacting said closed loop belt image bearing member and dissipating a first degree of static charge therefrom; and (ii) an active static removing assembly for additionally dissipating a second and desired degree of static charge from said closed loop belt image bearing member, said active static removing assembly having a conductive contact member for contacting said closed loop belt image bearing member, and a bias source for biasing said conductive contact member to apply a neutralizing bias having a selected polarity to said closed loop belt image bearing member, thereby effectively controlling static charge build up on said closed loop belt image bearing member, and substantially preventing undesirable machine failures.

3. The electrostatographic reproduction machine of claim 2, wherein said at least one conductive passive member comprises a conductive brush.

4. The electrostatographic reproduction machine of claim 2, wherein said at least one conductive passive member is in constant contact with the closed loop belt image bearing member.

5. The electrostatographic reproduction machine of claim 2, wherein said conductive contact member comprises a brush.

6. The electrostatographic reproduction machine of claim 2, wherein said bias source comprises a DC power supply.

7. The electrostatographic reproduction machine of claim 2, wherein said selected polarity of said neutralizing bias is opposite to a sensed polarity of static charge building up on the closed loop belt image bearing member.

8. The electrostatographic reproduction machine of claim 2, including an electrostatic voltage sensor (ESV) for measuring voltage and current levels induced in the closed loop belt image bearing member by built up static charge thereon.

9. The electrostatographic reproduction machine of claim 5, wherein said at least one conductive passive member comprises a grounded conductive carbon brush.

10. The electrostatographic reproduction machine of claim 7, wherein said conductive contact member comprises a conductive brush isolated from other machine potentials except for biasing voltage.

11. The electrostatographic reproduction machine of claim 8, wherein said DC power supply applies a bias having level of potential sufficient to produce a current equal to a current being induced in the closed loop belt image bearing member by the of static charging.

* * * * *